United States Patent [19]

Davis et al.

[11] 4,290,664

[45] Sep. 22, 1981

[54] MULTIPLE OUTLET TELEPHONE LINE ADAPTER

[75] Inventors: Robert W. Davis, New Hope, Minn.; Paul D. Tracy, Lawrenceville, Ill.

[73] Assignee: Communications Systems, Inc., Hector, Minn.

[21] Appl. No.: 80,154

[22] Filed: Sep. 28, 1979

[51] Int. Cl.[3] ..... H01R 13/506

[52] U.S. Cl. ..... 339/156 R; 339/210 M; 339/125 R; 179/1 PC

[58] Field of Search ..... 179/1 PC; 339/91 R, 339/103 R, 103 M, 107, 206 R, 206 P, 208, 210 R, 154 A, 156 R, 159 C, 219, 119 A, 125 R, 126 R

[56] References Cited

U.S. PATENT DOCUMENTS

| | | | |
|---|---|---|---|
| 3,705,378 | 12/1972 | Elkins | 339/208 X |
| 3,920,306 | 11/1975 | Barnett et al. | 339/107 X |
| 3,963,300 | 6/1976 | Patton et al. | 339/156 R |
| 4,070,548 | 1/1978 | Kasper | 339/154 A X |
| 4,103,985 | 8/1978 | Krolak et al. | 339/126 R |

FOREIGN PATENT DOCUMENTS

| | | | |
|---|---|---|---|
| 1099300 | 9/1955 | France | 339/159 C |
| 2371794 | 7/1978 | France | 339/119 R |

OTHER PUBLICATIONS

Telephone Engineer & Management, Jan. 1, 1979, P106, Reader Service item 343.

*Primary Examiner*—Eugene F. Desmond
*Attorney, Agent, or Firm*—Kinney, Lange, Braddock, Westman and Fairbairn

[57] ABSTRACT

A bridge adapter assembly connects a plurality of modular telephone cables and multiple conductor (e.g. twenty-five pair) telephone cables. The bridge adapter assembly includes a housing having first and second generally rectangular major surfaces which are generally parallel to one another, first and second generally rectangular side walls, and first and second generally rectangular end walls. A first multiple contact connector is mounted in an opening in the first side wall, and a second multiple contact connector is mounted in an opening in the second side wall. Modular connector jacks are mounted in openings in the first end wall and the second end wall. Conductors within the housing connect the first and second multiple contact connectors and the modular connector jacks. Since no connectors are provided on either the first or the second major surfaces, a plurality of the bridge adapter assemblies may be stacked to provide a large number of connections. The housing is preferably made of two identical halves which snap together. The multiple contact connectors and the modular connector jacks are held in position by the two halves of the housing without requiring any screws or other fasteners.

5 Claims, 7 Drawing Figures

Fig.1
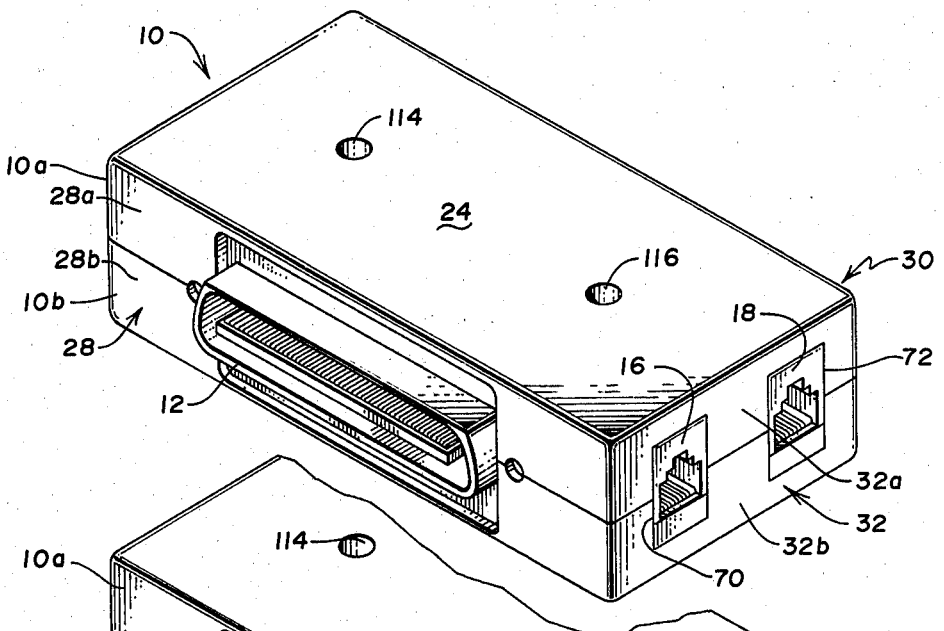
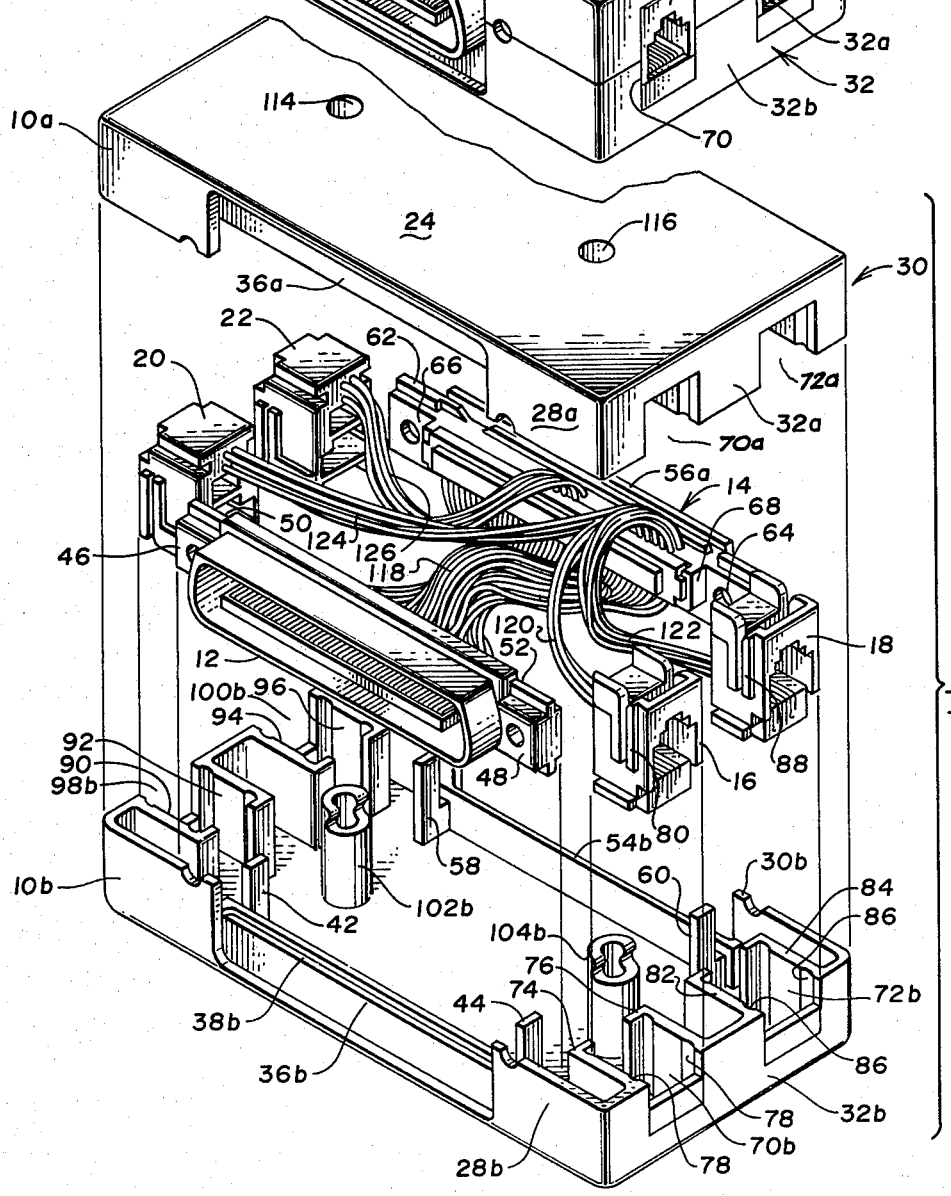
Fig.2

MULTIPLE OUTLET TELEPHONE LINE ADAPTER

BACKGROUND OF THE INVENTION

1. Field of the Invention

The present invention relates generally to electrical connectors. In particular, the present invention is a bridge adapter assembly which is preferably used for interconnecting individual telephones with multi-conductor telephone cables.

2. Description of the Prior Art

In the past, adapter assemblies have been developed for interconnecting telephones and other telephone equipment with a multi-conductor telephone cable. Examples of one type of adapter system are shown in U.S. Pat. No. 4,103,985, in which a multiple contact connector and a plurality of modular connector jacks are provided within a housing. A cover is mounted over the housing and has openings to permit cables to enter the housing and make connection with the multiple contact connector and the modular connector jacks.

A similar type of bridge adapter is the TRW Cinch Super Mod V telephone adapter system. This device uses five modular jacks, half tapped into two back-to-back, wired-through, twenty-five pair connectors. One of the connectors is a male type connector, while the other is a female type connector. The five modular jacks are mounted at the top of the housing, while the two twenty-five pair connectors are mounted on opposite sides of the housing.

SUMMARY OF THE INVENTION

The present invention is a bridge adapter assembly having a housing with first and second generally rectangular major surfaces, first and second generally rectangular side walls, and first and second generally rectangular end walls. First and second multiple contact connector means are mounted in openings in the first and second side walls, respectively. First and second modular connector means are mounted in openings in the first and second end walls, respectively. The first and second multiple contact connector means and the first and second modular connector means are interconnected by conductor means within the housing.

The bridge adapter assembly of the present invention has all of its connectors exposed at either the side walls or the end walls. No connectors are mounted or exposed on the first and second major surfaces. As a result, a plurality of bridge adapter assemblies may be stacked together to accommodate cables having more conductors than can be handled by a single bridge adapter assembly.

The bridge adapter assembly of the present invention preferably uses a housing which is split into two identical halves. The multiple contact connector means and the first and second modular connector means are held by the two halves of the housing without requiring any additional fasteners. The two halves preferably have posts with snap locking lips and grooves, so that the two halves of the housing are held together without requiring any additional fasteners. As a result, the adapter bridge assembly is easy to disassemble and reassemble and requires no special tools.

BRIEF DESCRIPTION OF THE DRAWINGS

FIG. 1 is a perspective view of the adapter assembly of the present invention.

FIG. 2 is an exploded perspective view of the adapter assembly of the present invention.

DETAILED DESCRIPTION OF THE PREFERRED EMBODIMENTS

Figure 3:
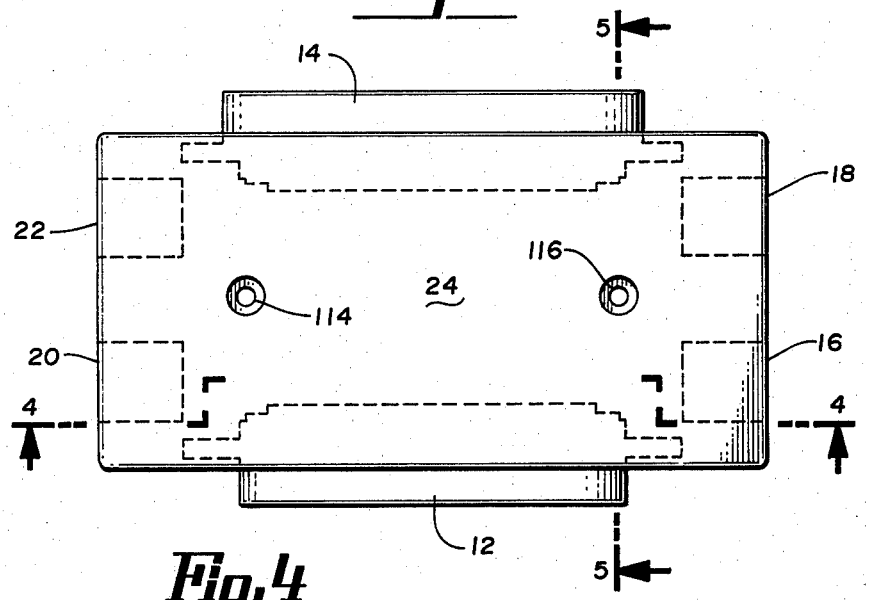
FIG. 3 is a top view of the adapter assembly.
Figure 4:
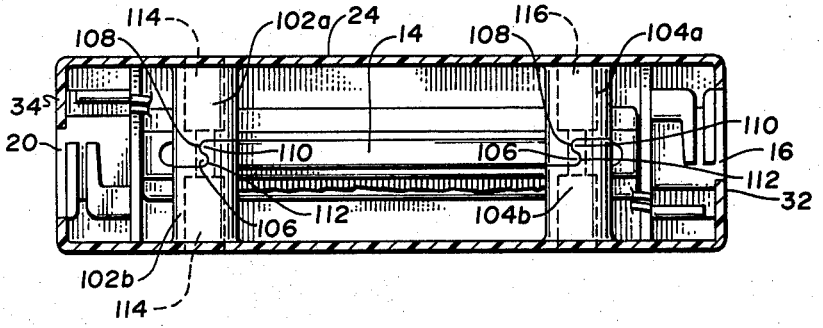
FIG. 4 is a sectional view along section 4—4 of FIG. 3.

FIGS. 1–7 show a preferred embodiment of the bridge adapter of the present invention which includes housing 10, male multiple contact connector 12, female multiple contact connector 14 and four modular telephone connector jacks 16, 18, 20, and 22. The bridge adapter shown in the Figures, therefore, permits connection of four telephones having modular connecting plugs to a multiple conductor telephone cable.

Housing 10 includes generally rectangular top surface 24, generally rectangular bottom surface 26, generally rectangular side walls 28 and 30 and generally rectangular end walls 32 and 34. Housing 10 is formed by top half 10*a* and bottom half 10*b*. Top and bottom halves 10*a* and 10*b* are identical to one another, and top half 10*a* is inverted and turned end-for-end with respect to bottom half 10*b*.

Sidewalls 28 and 30 and end walls 32 and 34, therefore, are partially formed by top half 10*a* and partially formed by bottom half 10*b*. In the Figure, the portions of sidewalls 28 and 30 and end walls 32 and 34 which are formed by top half 10*a* are designated 28*a*, 30*a*, 32*a*, and 34*a*, respectively. Similarly, the portions which are formed by bottom half 10*b* are designated 28*b*, 30*b*, 32*b*, and 34*b*, respectively. Because top and bottom halves 10*a* and 10*b* are identical to one another, but are inverted and turned end-for-end with respect to one another, side wall portions 28*a* and 30*a* of top half 10*a* are identical to portions 30*b* and 28*b*, respectively, of bottom half 10*b*. Similarly, end wall portions 32*a* and 34*a* of top half 10*a* are identical to end wall portions 34*b* and 32*b*, respectively, of bottom half 10*b*.

Figure 6:
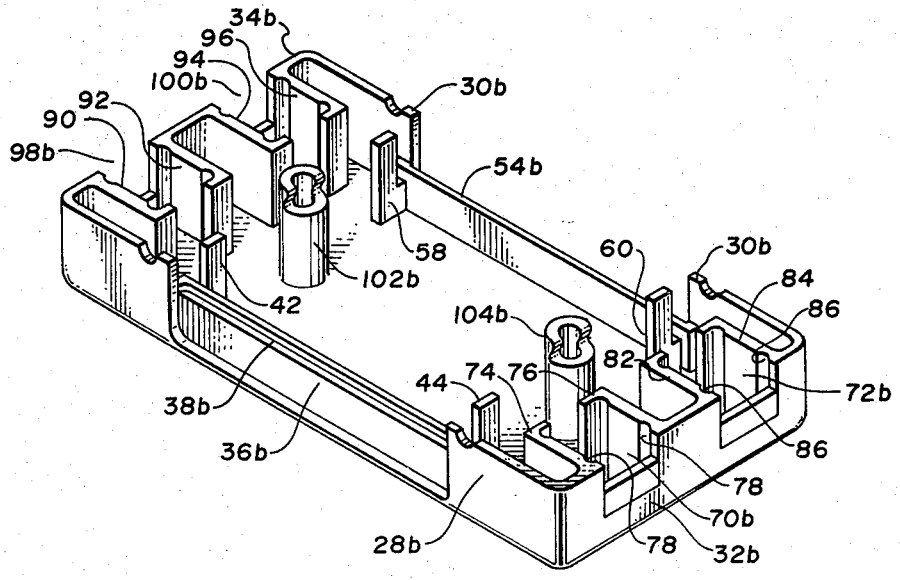
FIG. 6 is a perspective view showing the bottom half of the housing of the adapter assembly of the present invention.
Figure 5:
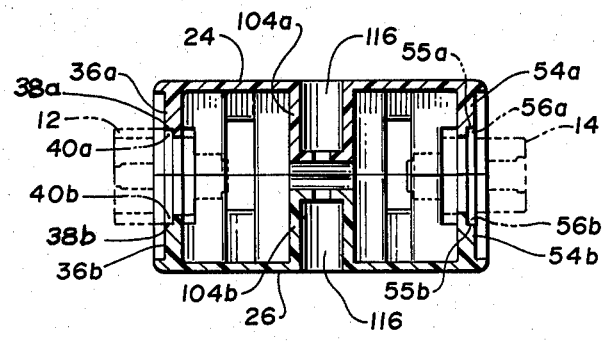
FIG. 5 is a sectional view along section 5—5 of FIG. 3.
Figure 7:
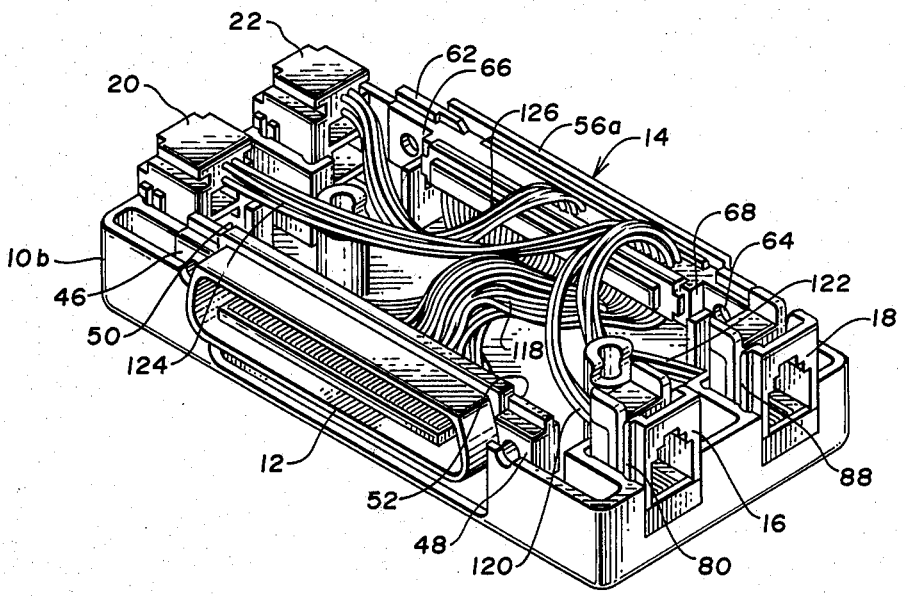
FIG. 7 is a perspective view showing the bottom half of the housing with the connectors and conductors in place.

FIG. 2 (which is an exploded view of the bridge adapter), FIG. 6 (which is a view of only the bottom half 10*b* of housing 10), and FIG. 7 (which is a view of bottom half 10*b* with connectors and conductors in place) illustrate how housing 10 holds connectors 12 and 14 and modular jacks 16, 18, 20 and 22 in position without requiring any fasteners.

As shown in the Figures, connectors 12 and 14 are mounted in openings in side walls 28 and 30, respectively. The opening in side wall 28 is formed by recessed side walls 36*a* and 36*b*, which are slightly recessed from the main side walls 28*a* and 28*b*, and do not extend to the entire height of side wall portions 28*a* and 28*b*. Recessed side walls 36*a* and 36*b* have notches 38*a* and 38*b*, respectively, which receive shoulder 40*a* or 40*b*, respectively, of connector 12.

As best shown in FIG. 6, bottom half 10*b* has upstanding rectangular posts 42 and 44 located at the ends of recessed side wall 36*b*. Posts 42 and 44 are spaced from first side wall portion 28*b* so that the lower portions of mounting flanges 46 and 48, respectively, of connector 12 are held securely between posts 42 and 44 and the inner surface of side wall 28*b*. In addition, posts 42 and 44 are spaced from one another so that the lower portions of shoulders 50 and 52 of connector 12 are held in engagement with posts 42 and 44. First side wall portion 28*b*, recessed side wall 36*b*, and posts 42 and 44 hold the bottom half of connector 12 in position in the opening. Similar posts (not shown) in upper half 10*a* cooperate with first side wall portion 28*a* and recessed side wall 36*a* to hold the upper portions of connector 12.

Female connector 14 is held in position in a similar manner. An opening in second side wall 30 is provided by recessed side walls 54*a* and 54*b*. The edges of recessed side walls 54*a* and 54*b* have notches 55*a* and 55*b* to receive flanges 56*a* and 56*b*, respectively, of female connector 14. Posts 58 and 60 in lower half 10*b* cooperate with the inner surfaces of second side wall portion 30*b* to hold the lower portions of flanges 62 and 64 of female connector 14. Posts 58 and 60 are spaced from one another so as to cooperate with and hold the lower portions of shoulders 66 and 68 of female connector 14.

The upper half of female connector 14 is held in position by posts (not shown) in upper half 10*a*, together with recessed side wall 54*a* and the inner surfaces of second side wall portion 30*a*.

As shown in the Figures, modular jack 16 is mounted in opening 70 in first end wall 32. Opening 70 is formed by upper opening 70*a* in upper half 10*a* and lower opening 70*b* in lower half 10*b*. Similarly, modular jack 18 is mounted in opening 72 which is formed by upper opening 72*a* and lower opening 72*b*.

Inner walls 74 and 76 form a pocket or receptacle for the lower half of modular jack 16. In the preferred embodiments shown in the Figures, inner walls 74 and 76 have grooves 78 which cooperate with bosses 80 on opposite sides of modular jack 16. Inner walls 82 and 84 provide a similar pocket or receptacle for the lower half of modular jack 18. Grooves 86 are provided in walls 82 and 84 which cooperate with bosses 88 on opposite sides of modular jack 18.

Upper half 10*a* of housing 10 has similar inner walls (not shown) which provide pockets for the upper halves of jacks 16 and 18. These inner walls (not shown) are identical to inner walls 90 and 92, which form a pocket for the lower half of jack 20, and inner walls 94 and 96, which form a pocket for holding the lower half of jack 22.

Due to the shape of jacks 16, 18, 20 and 22, lower openings 70*b* and 72*b* are not as large as upper openings 70*a* and 72*a*. At the opposite end, lower openings 98*b* and 100*b* in lower end wall portion 34*b* are larger than the upper openings (not shown) in upper end wall portion 34*a*. As a result, jacks 20 and 22 are inverted with respect to plugs 16 and 18. In this way, identical top and bottom halves 10*a* and 10*b* of housing 10 are permitted.

Top and bottom halves 10*a* and 10*b* are connected together by posts 102*a* and 104*a* which extend downward from the inner surface of top 24, and posts 102*b* and 104*b* which extend upward from the inner surface of bottom 26. Post 102*a* is identical to post 104*b*, and post 102*b* is identical to post 104*a*. Posts 102*a* and 104*a* each have a lip 106 and a groove 108 which cooperate with corresponding lips 110 and grooves 112 of lower posts 102*b* and 104*b*. In the preferred embodiments, housing 10 is made of a high impact plastic, and posts 102*a*, 102*b*, 104*a*, and 104*b* have sufficient resiliency to permit lips 106 and 110 to slide past one another and then snap into grooves 108 and 112, respectively. Once snapped together, top and bottom halves 10*a* and 10*b* are held together in position by the lip and groove arrangement until sufficient force is applied to pull the halves apart. This snap lock connection permits the entire adapter housing 10 to be assembled without the need for any fasteners.

Posts 102*a* and 102*b* and posts 104*a* and 104*b* are hollow, with hole 114 extending through posts 102*a* and 102*b* and hole 116 extending through posts 104*a* and 104*b*. Holes 114 and 116 may be used in fastening the housing 10 to a wall or other surfaces.

One important advantage of the present invention is that the major surfaces, i.e. top surface 24 and bottom surface 26 are flat and parallel, and have no connectors exposed at these surfaces. As a result, a plurality of adapter assemblies similar to the adapter assembly shown in FIG. 1 may be stacked together. Screws can extend through the lined-up holes 114 and 116 in the various housings to attach all of the adapter assemblies together. It is extremely simple, therefore, to provide an adapter for cables having more than twenty-five pair of conductors.

As best shown in FIGS. 2 and 7, connectors 12 and 14 are connected back-to-back by conductors 118. Conductors 120 connect modular jack 16 to connector 114 and through connectors 118 also to connector 12. Similarly, conductors 122 connect jack 18 to connectors 12 and 14, conductors 124 connect jack 20 to connectors 12 and 14, and conductors 126 connect jack 22 to connectors 12 and 14. The plurality of conductors to each modular jack comprises a separate phone or communication line set.

Because all of the components slide into position and are held by upper and lower halves 10*a* and 10*b*, the present invention permits either connector 12 or 14 to be removed and twisted by 180° and then reinserted in the same opening. This results in the incoming cable which is connected to that connector being reversed in direction. This is a significant advantage, since in some cases the physical location of the adapter dictates that the cables connected to connectors 12 and 14 must run from a particular direction.

Because all connectors and jacks are held securely in position when top and bottom halves 10*a* and 10*b* are snapped together, they do not need to be potted in the housing. As a result, all conductors and connections of those conductors to the connectors 12 and 14 and jacks 16, 18, 20, and 22 are easily accessible. The connectors or jacks may be removed temporarily to permit modification, rewiring, or splicing, and then slipped back into position in top or bottom halves 10*a* or 10*b*. This permits maximum flexibility, and permits easy modification on site by the installer, if necessary.

Although the preferred embodiment shown in the Figures has male and female multi-conductor connectors 12 and 14 and four modular jacks 16, 18, 20, and 22, other combinations may also be used. For example, by increasing the width of housing 10 additional modular jacks can be accommodated.

Although the present invention has been described with reference to preferred embodiments, workers skilled in the art will recognize that changes may be made in form and detail without departing from the spirit and scope of the invention.

We claim:

1. A bridge adaper assembly for a communication system having a plurality of communication line sets, each consisting of a plurality of conductors comprising:

a housing comprising upper and lower identical halves having first and second generally rectangular major surfaces generally parallel to one another, first and second generally rectangular side walls, and first and second generally rectangular end walls, the upper half comprising the first major surface and half of the first and second side walls and half of the first and second end walls, and the lower half comprising the second major surface and half of the first and second side walls and half of the first and second end walls;

the openings in the first and second side walls and the first and second end walls each having an opening defined therein and each opening being formed partially in the upper half and partially in the lower half of the housing;

first multiple contact connector means mounted in an opening in the first side wall and having contacts for connection to more than one communication line set;

second multiple contact connector means mounted in an opening in the second side wall and having contacts for connection to more than one communication line set;

said first and second multiple contact connector means having flanges on the edges thereof, and being retained in the respective openings in either of two positions, each rotated 180° from the other position;

first and second modular connector means each having flanges on the edges thereof and each modular connector means being coupled to contacts for one communication line set of the multiple contact connector means;

first inner walls within the housing halves and proximate the opening in the first end wall, the first inner walls defining a first pocket for slidably receiving and holding the first modular connector means;

second inner walls within the housing halves and proximate the opening in the second end wall, the second inner walls defining a second pocket for slidably receiving and holding the second modular connector means;

snap lock means for connecting together the top and bottom halves of the housing comprising first and second posts projecting from an inner surface of the first major surface, the first and second posts each having a lip and groove proximate their free ends, third and fourth connecting posts projecting from an inner surface of the second major surface, the third and fourth posts each having a lip and groove proximate their free ends, wherein the first and second posts and the third and fourth posts are positioned within the housing so that the lip and groove of the first post cooperate with the lip and groove of the third post, and the lip and the groove of the second post cooperate with the lip and groove of the fourth post to connect and hold together the upper and lower halves of the housing; and conductor means within the housing for connecting a plurality of communication line sets between the first and second multiple contact connector means, said conductor means having sufficient length to permit one of the multiple contact connector means to be rotated between its two positions.

2. The bridge adapter assembly of claim 1 and further comprising at least one modular connector means mounted in an opening in the first end wall, and only one communication line set to each modular connector means.

3. A bridge adapter assembly for a communication system having a plurality of communication line sets, each consisting of a plurality of conductors comprising:

a housing having first and second generally rectangular major surfaces generally parallel to one another, first and second generally rectangular side walls, and first and second generally rectangular end walls, said housing comprising upper and lower substantially identical halves;

a separate opening defined in each of the first and second side walls and in at least one end wall, each opening being partially formed in the upper half and partially formed in the lower half;

first multiple contact connector means mounted in an opening in the first side wall and having contacts for connecting to more than one communication line set;

second multiple contact connector means mounted in an opening in the second side wall and having contacts for connecting to more than one communication line set;

at least one modular connector means for a single communication line set mounted in an opening in one of the end walls;

conductor means within the housing for connecting a plurality of communication line sets between the first and second multiple contact connector means and only one communication line set to each modular connector means; and snap lock means for connecting together the top and bottom halves of the housing comprising first and second posts projecting from an inner surface of the first major surface, the first and second posts each having a lip and groove proximate their free ends, third and fourth connecting posts projecting from an inner surface of the second major surface, the third and fourth posts each having a lip and groove proximate their free ends, and wherein the first and second posts and the third and fourth posts are positioned within the housing so that the lip and groove of the first post cooperate with the lip and groove of the third post, and the lip and the groove of the second post cooperate with the lip and groove of the fourth post to connect and hold together the upper and lower halves of the housing.

4. The bridge adapter assembly of claim 3 and further comprising:

a first mounting hole passing through the first major surface, the first post, the third post, and the second major surface; and a second mounting hole passing through the first major surface, the second post, the fourth post, and the second major surface.

5. The bridge adapter assembly of claim 3 wherein said at least one modular connector means is mounted in an opening in the first end wall, and a second modular connector means mounted in an opening in the second end wall and conductor means connecting a separate communication line set to each modular connector means, there being modular connector means only in the end walls of the housing.

* * * * *